US010773308B2

(12) United States Patent
O'Hara et al.

(10) Patent No.: US 10,773,308 B2
(45) Date of Patent: Sep. 15, 2020

(54) ROTOR AND METHOD OF MANUFACTURING ROTOR WITH EQUALIZED SURFACE AREAS FOR GRINDING

(71) Applicant: GKN Sinter Metals, LLC, Auburn Hills, MI (US)

(72) Inventors: Douglas R. O'Hara, Salem, IN (US); James T. Hill, Salem, IN (US)

(73) Assignee: GKN Sinter Metals, LLC, Auburn Hills, MI (US)

( * ) Notice: Subject to any disclaimer, the term of this patent is extended or adjusted under 35 U.S.C. 154(b) by 0 days.

(21) Appl. No.: 16/475,881

(22) PCT Filed: Dec. 22, 2017

(86) PCT No.: PCT/US2017/068232

§ 371 (c)(1),
(2) Date: Jul. 3, 2019

(87) PCT Pub. No.: WO2018/128860

PCT Pub. Date: Jul. 12, 2018

(65) Prior Publication Data

US 2019/0375019 A1 Dec. 12, 2019

Related U.S. Application Data

(60) Provisional application No. 62/441,827, filed on Jan. 3, 2017.

(51) Int. Cl.
*F01L 1/34* (2006.01)
*B22F 3/24* (2006.01)
(Continued)

(52) U.S. Cl.
CPC ..... *B22F 3/24* (2013.01); *B22F 5/08* (2013.01); *B22F 5/10* (2013.01); *F01L 1/3442* (2013.01); *B22F 2003/247* (2013.01); *B22F 2998/10* (2013.01); *F01L 2301/00* (2020.05); *F01L 2303/00* (2020.05)

(58) Field of Classification Search
CPC ..... B22F 5/10; B22F 5/08; B22F 3/24; B22F 2998/10; B22F 2003/247; F01L 1/3442; F01L 2103/01; F01L 2103/00; F01L 2101/00; F01L 2001/34453; F01L 2820/01
See application file for complete search history.

(56) References Cited

U.S. PATENT DOCUMENTS

2007/0175426 A1* 8/2007 Knecht ..... F01L 1/3442 123/90.17
2012/0132160 A1 5/2012 Malen et al.
(Continued)

OTHER PUBLICATIONS

PCT International Search Report and Written Opinion, PCT/US2017/068232, dated Apr. 17, 2018, 13 pages.

*Primary Examiner* — Zelalem Eshete
(74) *Attorney, Agent, or Firm* — Quarles & Brady LLP

(57) ABSTRACT

A rotor for a variable valve timing engine is disclosed in which the opposing planar surface(s) of the rotor have one or more recesses formed therein in order to balance, equilibrate, or equalize the planar surface areas on the opposing surfaces. Among other things, this can improve the accuracy and efficiency with which the rotor is ground during a related method of manufacturing the rotor.

18 Claims, 3 Drawing Sheets

(51) Int. Cl.

| | |
|---|---|
| ***B22F 5/08*** | (2006.01) |
| ***B22F 5/10*** | (2006.01) |
| ***F01L 1/344*** | (2006.01) |

(56) References Cited

U.S. PATENT DOCUMENTS

| | | | | |
|---|---|---|---|---|
| 2013/0081585 | A1 | 4/2013 | Braun | |
| 2016/0010515 | A1* | 1/2016 | Snyder | F01L 1/3442 123/90.15 |
| 2016/0305292 | A1 | 10/2016 | Weber et al. | |

* cited by examiner

ROTOR AND METHOD OF MANUFACTURING ROTOR WITH EQUALIZED SURFACE AREAS FOR GRINDING

CROSS-REFERENCE TO RELATED APPLICATION

This application represents the national stage entry of International Application No. PCT/US2017/068232 filed Dec. 22, 2017, and claims the benefit of the filing date of U.S. Provisional Patent Application No. 62/441,827 entitled "Rotor and Method of Manufacturing Rotor with Equalized Surface Areas for Grinding" filed on Jan. 3, 2017, which are hereby incorporated by reference for all purposes as if set forth in their entirety herein.

STATEMENT OF FEDERALLY SPONSORED RESEARCH OR DEVELOPMENT

Not applicable.

FIELD OF THE INVENTION

This disclosure relates to rotors for a variable valve timing (VVT) engine and related methods for manufacturing rotors of this type in which the surface areas of the pair of parallel planar surfaces to be ground are modified in order to provide improved grinding.

BACKGROUND

In internal combustion engines, variable valve timing (VVT) describes mechanisms and related methods that can be used to alter the shape or timing of a valve lift event within an internal combustion engine. VVT engines allows the lift or timing of the intake and/or exhaust valves to be changed during operation of the engine.

In a VVT engine, the rotor and the stator often have a complex shape. In particular, the rotor body typically includes a main body with vanes, channels for oil or air transport, and a central bore hole for assembly to the camshaft. The vanes, in combination with the stator housing, define variable oil or air pressure chambers inside a stator housing. The channels allow for the oil or air transport from one pressure chamber to other pressure chambers.

SUMMARY

Given the complex and asymmetrical shape of the rotor, efficient fabrication of the rotor can be difficult. Because powder metallurgy is an efficient way to produce high volume parts, many rotors are now made by compacting powder metal into a preform resembling the rotor and sintered at elevated temperatures to form the sintered rotor body. However, because of the very precise geometric requirements of the rotors given their end use in an engine, the sintered powder metal rotors still require a final finishing step to prepare the axial faces of the rotor to achieve precise dimensions and flatness.

However, one particular issue that arises is that, since different axial faces of the rotor have different geometries and patterns, it can be difficult to evenly grind the axial faces. Typically, an unfinished rotor is placed in a grinding machine in which both of the axial faces are simultaneously ground. In many instances, because the axial faces are uneven, one axial face will need to be ground longer than is required by that face alone because of the requirements of the opposing axial face. This can result in, among other things, that the time for grinding is lengthened to the time required to grind the side that will take the longest to grind, that one side will have more stock or material removed than the other, and that dimensional stability from part to part may be more difficult to control.

Disclosed herein is a way of improving the production process for a VVT rotor by balancing the surface areas that are ground. Conceptually, the surface having the larger surface area that contacts the grinding wheel is intentionally formed to have a reduced surface area that contacts the wheel by electively recessing areas that otherwise might form part of the axial side to be ground, thereby equilibrating the opposing surface areas that are ground (or at least bringing the surface areas of the two axial sides closer to one another).

According to one aspect, a method of manufacturing a rotor for a variable valve timing engine is disclosed. The method includes the steps of compacting a powder metal material in a tool and die set to form a powder metal compact, sintering the powder metal compact to form a sintered powder metal part, and grinding the sintered powder metal part. The sintered powder metal part compact has a pair of axial sides each having a respective planar surface to provide a pair of planar surfaces on the sintered powder metal part that are parallel with one another and facing oppositely away from one another. At least one of the pair of axial sides has one or more recessed surfaces axially offset from the respective planar surface to equalize a surface area of the respective planar surface with a surface area of the other planar surface. During the step of grinding, this pair of planar surfaces are ground simultaneously to produce a pair of finished planar surfaces on the sintered powder metal part to produce the rotor.

In some forms of the method, the surface areas of each one of the pair of planar surfaces may be within 15%, 10%, or 5% of each other. Among other things, this can help equilibrate the surface areas being ground. While it is contemplated the surfaces may simply be brought close to one another in comparative surface area in order to experience many of the benefits of the process, in some forms, the surface areas may be made equal with one another.

The rotor may include a central body having a plurality of vanes extending radially outward from the central body. To help equilibrate the surface areas in some forms, on one or both of the pair of planar surfaces each of the plurality of vanes may have a recessed surface formed therein. In some forms, the sintered powder metal body may have an axially-extending through hole and, on one axial side of the sintered powder metal body, the central body may have a counterbored surface extending to the axially-extending through hole and, on the other axial side of the central body, the central body may have a recessed surface. The recessed surface on the central body may be inwardly spaced from an outer peripheral edge and an inner peripheral edge of the respective planar surface on which it is located such that the inner peripheral edge is shared with the axially-extending through hole.

In some forms, both of the pair of planar surfaces each may have one or more recessed surfaces axially offset respectively therefrom.

In some forms, the recessed surface may be inwardly spaced from a peripheral edge of a respective one of the pair of planar surfaces. For example, the recessed surface may be spaced at least 2 mm from the peripheral edge.

In some forms of the method, the step of grinding the pair of planar surfaces simultaneously may involve a parallel pair of grinding discs rotating in opposite directions relative to one another. However, in other forms, the step of grinding the pair of planar surfaces simultaneously may involve a parallel pair of grinding discs rotating in the same direction relative to one another.

It is contemplated that, in some forms, the recessed surface(s) may be between 0.1 mm and 0.2 mm deep relative to the respective planar surface after grinding.

According to another aspect, a rotor for a variable valve timing engine is disclosed. The rotor includes a central body with a plurality of vanes extending radially outward from the central body in which the central body and the plurality of vanes are a unitary component made of or comprising a sintered powder metal. The rotor has a pair of axial sides each having a respective planar surface to provide a pair of planar surfaces on the rotor that are parallel with one another and facing oppositely away from one another (in the final part, these planar surfaces will be "finished" or ground). One or both of the pair of axial sides have at least one recessed surface axially offset from the respective planar surface to equalize a surface area of the respective planar surface with a surface area of the other planar surface.

In some forms, the surface areas of each one of the pair of planar surfaces may be within 15%, 10%, or 5% of each other.

In some forms, the sintered powder metal body may have an axially-extending through hole. On one axial side of the sintered powder metal body, the central body may have a counter-bored surface extending to the axially-extending through hole and, on the other axial side of the sintered powder metal body, the central body may have a recessed surface. In both of the pair of planar surfaces, each of the plurality of vanes may have a recessed surface formed therein.

In some forms, both of the pair of planar surfaces may each have at least one recessed surface axially offset respectively therefrom.

In some forms, the least one recessed surface may be inwardly spaced from a peripheral edge of a respective one of the pair of planar surfaces, may be spaced at least 2 mm from the peripheral edge, and may be between 0.1 mm and 0.2 mm deep relative to the respective planar surface.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION

Figure 1A:
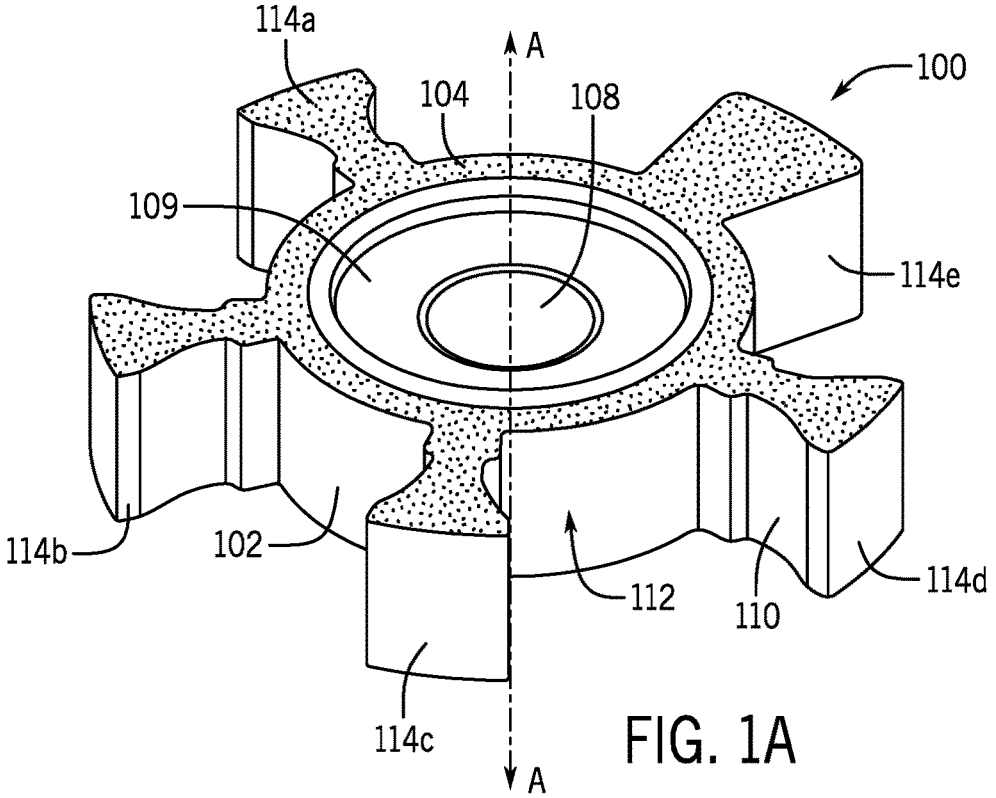
FIG. 1A is a perspective view of one side of a conventional rotor for a variable valve timing engine.
Figure 1B:
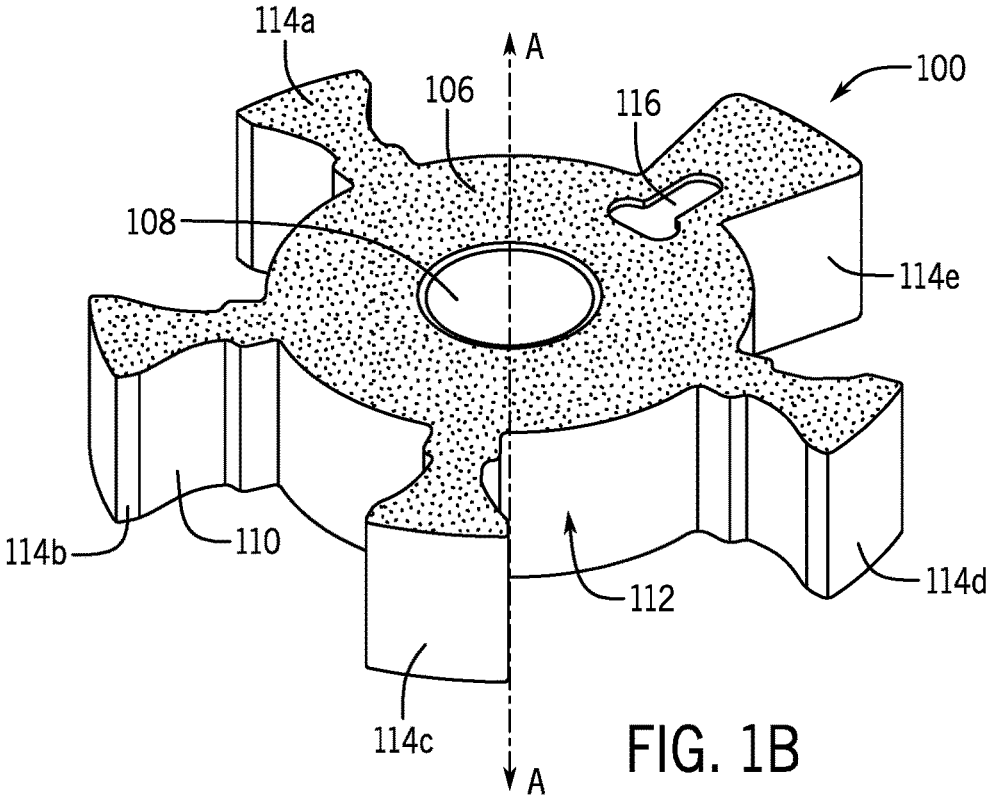
FIG. 1B is a perspective view of the other side of the rotor of FIG. 1A.

Referring first to FIGS. 1A and 1B, a conventional rotor 100 is illustrated. A rotor of this type may be one component of a variable valve timing (VVT) engine and the details of how the rotor interacts with other components in a VVT engine is known from the state of the art and will not be described in greater detail herein. It is sufficient to know that the VVT rotors have exceptionally small dimensional tolerances and precise requirements relating to flatness and parallelism of many of the opposing planar surfaces as the rotor is used in an assembled engine where even small deviations (on the order of magnitude of a thickness of a human hair) may be unacceptable.

The rotor 100 has a body 102 that extends from a first planar surface 104 (shown as a speckled or stippled surface to indicate the plane and only for purposes of illustration) to a second planar surface 106 (also shown as a speckled or stippled surface to indicate the plane) in which the second planar surface 106 is opposite from and parallel with the first planar surface 104. Between the first planar surface 104 and the second planar surface 106 there is a central through hole 108, which is circular in the form shown and which also includes a counter bore 109 from the first planar surface 104 in the particular form shown. This central through hole 108 defines a central axis A-A of the rotor 100. The body 102 also has an outer periphery 110 which extends perpendicularly from the first planar surface 104 to the second planar surface 106 and which defines the general shape of the rotor 100 when the rotor is viewed from either axial end. As shown, the rotor 100 is shaped to have a central core section 112 (through which the central bore 108 extends) which is generally round when viewed from an axial side and a plurality of vanes 114*a*-114*e* which extend generally axially from the central core section 112. In the particular form shown, there are five vanes including four identical vanes 114*a*-114*d* with shaped angular sides and one different vane 114*e* with a generally radially-extending flat angular side. On the second planar surface 106, there is a recessed T-slot 116 which extends from the core section 112 into the vane 114*e*. It should be appreciated that while five vanes are shown in the illustrated example, that this design is exemplary only and that other numbers and shapes of vanes and profiles of the central core section might be used in other rotor designs.

Rotors such as the rotor 100 illustrated are often fabricated using powder metallurgy, for example. In one form, the loose powder metal and lubricant and/or binder may be compacted under pressure in a tool and die set to form a powder metal compact. This compact may then be sintered at temperatures near the melting point of the powder metal (and even at temperatures potentially exceeding the melting point of some, but not all, constituents of the powder metal). This sintering permanently joins the particles of the powder metal together and increases the density of the component.

As mentioned above, rotors of this type require extremely flat and parallel planar surfaces (such as opposing surfaces 104 and 106 in the illustrated rotor 100) with very tight tolerances. While parts made using powder metallurgical techniques do have very good dimensional accuracy in the as-sintered state, a post-sintering grinding step must occur to get those opposing surfaces within the flatness, distance, and parallelism requirements. This is often achieved using a grinding machine such as, for example, the Lapmaster® Wolters AC 1200 double-sided batch processing machine. In machines of this type, parallel grinding discs simultaneously grind the opposing planar surfaces on the rotors to flatten these surfaces and space them to the proper specifications. Typically, but not always, the grinding discs rotate in opposite directions from one another and at different rates of rotation as the grinding discs remove material from the opposing planar surfaces of the rotor.

However, conventional fine grinding of these opposing faces is often a slow process in order to maintain process control. Among other things, the faster the grinding wheels spin, the less accurate the grinding is. Moreover, comparing FIGS. 1A and 1B, it can be seen that the first and second planar surfaces 104 and 106 have different areas which can make it difficult to evenly grind the two surfaces since there are different amounts of material that are removed from each side. In the illustrated rotor 100, the first planar surface 104 has a surface area of 12.06 $cm^2$ and the second planar surface 106 has a surface area of 19.79 $cm^2$. These differences in surface areas mean that one side may effectively be ground to appropriate flatness, while grinding must still continue forward to finish the other side to appropriate flatness. Alternatively, these differences in surface area may also mean that, if the grinding wheels are spun at different rates so that both sides are completed at approximately the same time, one of the two sides may lengthen the overall time for grinding.

Figure 2A:
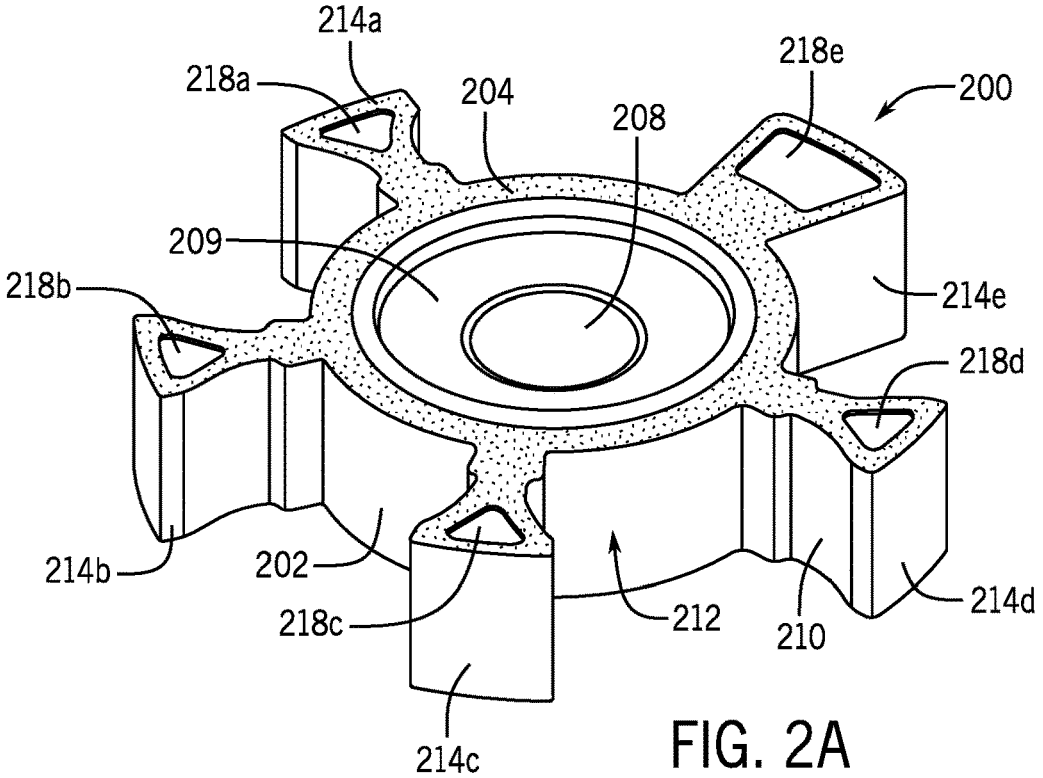
FIG. 2A is a perspective view of one side of an improved rotor for a variable valve timing engine, in which the rotor has a modified structure from the rotor of FIGS. 1A and 1B.
Figure 2B:
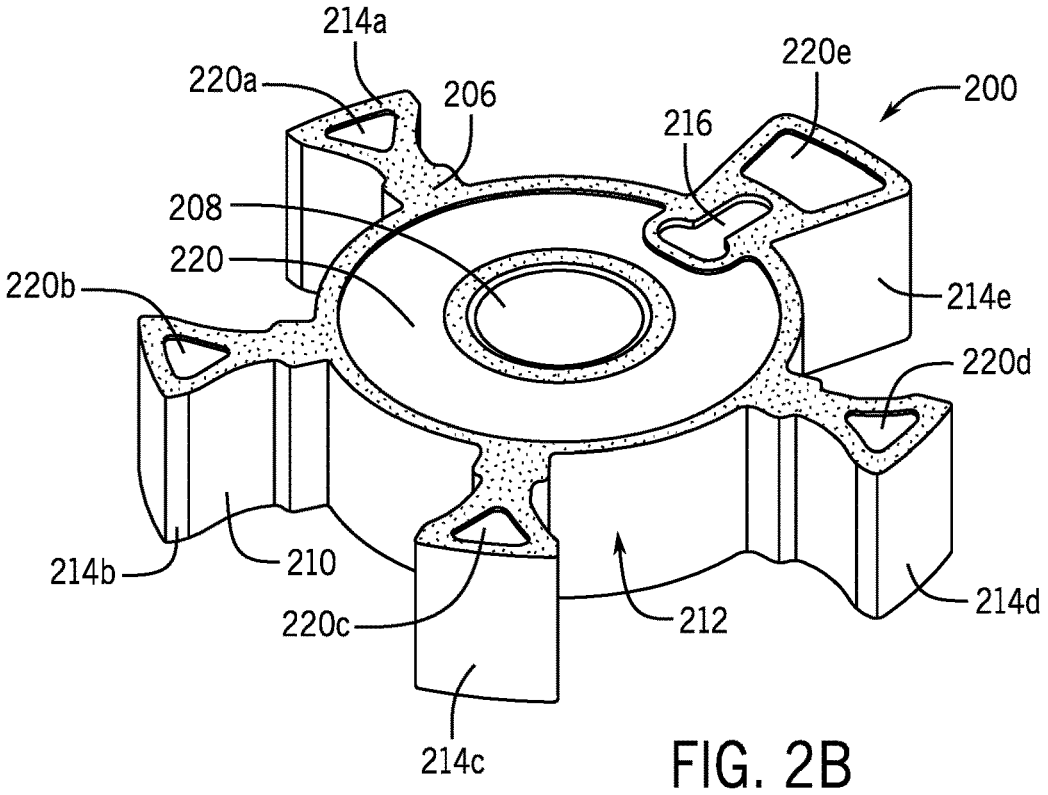
FIG. 2B is a perspective view of the other side of the rotor of FIG. 2A.

Turning now to FIGS. 2A and 2B, an improved rotor 200 is illustrated which is a modified version of the conventional rotor 100. The structural changes embodied in the improved rotor 200 permits for improved, faster, and more accurate grinding of the opposing surfaces. The rotor 200 in FIGS. 2A and 2B is identical to the rotor 100 in FIGS. 1A and 1B with the exception of the differences found in the illustrations and text below. To avoid redundancy in description, otherwise similar features from the 100-series reference numerals are indicated by corresponding 200-series reference numerals. For example, the outer periphery 210 in FIGS. 2A and 2B corresponds to outer periphery 110 in FIGS. 1A and 1B.

The primary difference between the rotor 100 in FIGS. 1A and 1B and the rotor 200 in FIGS. 2A and 2B is that the axial sides of the rotor 200 have multiple recessed surfaces axially offset from their respective planar surfaces 204 and 206 (which again are speckled or stippled to highlight the planar surfaces and to make comparisons of their relative surface areas clearer). Looking at FIG. 2A, on the first planar surface 204 in each of the vanes 214*a*-214*e*, there is a corresponding recessed surface 218*a*-218*e* in which recessed surfaces 218*a*-218*d* all are generally triangular in shape while the recessed surface 218*e* is four-sided with partial arcuate sections. Looking at FIG. 2B, on the second planar surface 206 there are again recessed sections 220*a*-220*e* in each vane 214*a*-214*e* similar to the recessed surfaces 218*a*-218*e* and also a generally donut-shaped recess 220 on the second planar surface 206 between the circular segments of the outer periphery 220 and the circular portion of the central through hole 208. The shapes of the various recesses are exemplary only and other types of recessed shapes may be used depending on the areas and shape of the body 202.

In the illustrated version of the rotor 200, the various added recessed surfaces are all offset at least 2.0 mm from the peripheral edges of the planar surfaces 204 and 206 of the body 202 (i.e., the outer periphery 210 and the inner diameter chamfer or inner peripheral edge of the central through hole 208) and at least 1.5 mm offset from the relief of the T-slot 216. In some forms, it is contemplated that this edge offset may be reduced to as little as 1.2 mm. This helps to ensure that there is sufficient material at each of the edges to remove and keep the part level during grinding. Moreover, it permits the rotor to maintain the structural edges at those locations which are employed during use in a VVT engine. However, it is contemplated that this offset thickness from the edges may be varied depending on the particular part and grinding speeds or rates employed. In the illustrated embodiment, the recessed regions are targeted to have a depth of 0.127 mm after grinding, although this recessed depth value is exemplary in nature. As an exemplary range, it is contemplated that the recessed surface(s) could be between 0.1 mm and 0.2 mm deep relative to the respective planar surface after grinding.

As modified, the surface areas of the first planar surface 204 and the second planar surface 206 of the improved rotor 200 are comparably equalized from the surface areas of the first planar surface 104 and the second planar surface 106 of the conventional rotor 100. In the illustrated rotor 200, the first planar surface 204 has a surface area of 10.11 $cm^2$ and the second planar surface 206 has a surface area of 9.29 $cm^2$. It is also noted that both surface areas are less than their comparable pre-recessed design states, meaning there is less material to remove on each side during grinding.

It should also be noted that these are removed regions and features on these planar surfaces which have been removed primarily for bringing the surface areas together. These newly added recesses perform no function other than to equalize the opposing surface areas and so they may be referred to, in some contexts, as "non-functional surface-reducing recesses" to distinguish them from other features such as the T-slot or the counter bore 209 which have a primary function not tied to surface area reduction as these structures complement or interact with other structures in the VVT engine during operation.

Although not perfectly equal, this equilibration of the two surface areas even the grinding performance side to side. It is contemplated that in some forms, the surface areas may be equal, within 5% of one another, within 10% of one another, or within 15% of one another. Closer values between the surface areas would generally be preferred in most instances, but exact equality may not be necessary to obtain many of the benefits described herein.

By equilibrating, equalizing, or balancing the surface areas, many benefits may be achieved during the subsequent grinding process. As one example, equilibrating, equalizing, or balancing the surface areas can reduce setup and grind time on the fine grinding equipment. This reduction in grind time can result in increased throughput and tighter length or thickness control of the rotor and more uniform part-to-part variance across a population of parts.

It should be appreciated that, while the rotor 200 has multiple recessed surfaces on each of the axial sides of the rotor 200, it is contemplated that, in other forms, there may be one or more recessed surfaces on one or both of the axial sides. Thus, it is contemplated that, in some forms, one side may have no recessed surfaces, while the other side may have one or more. It is also contemplated that, in some forms, one side may have one or more recessed surfaces while the other side may have one or more recessed surfaces. In those forms, the opposing sides might have the same number or different numbers of recessed surfaces.

Still yet, it should be appreciated that further balancing or equalizing may be achieved by not just reducing surface area by the addition of these recesses, but by also altering where the remaining surface area is located on the respective surface (e.g., relative to the central axis).

Figure 3:
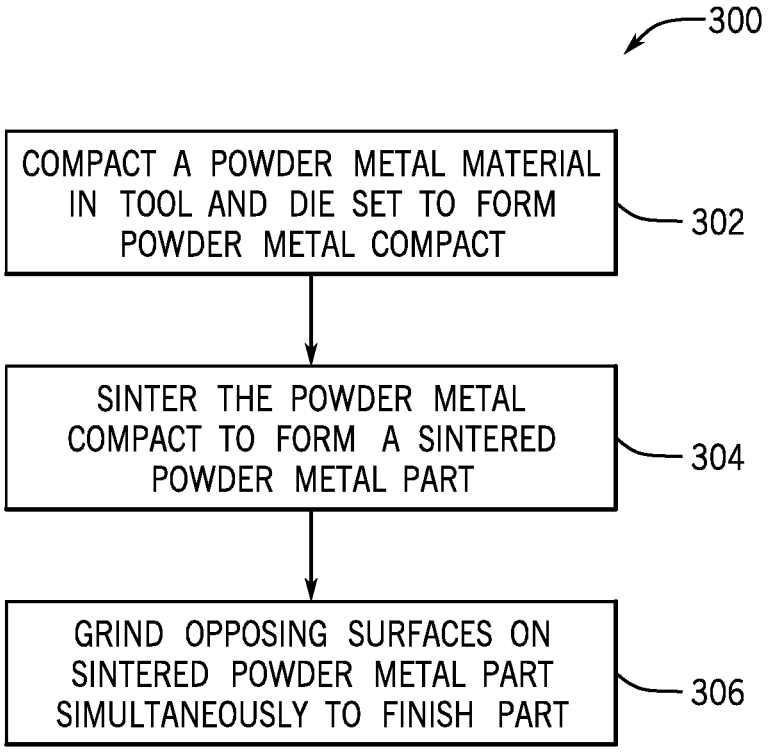
FIG. 3 is a flow chart outlining the steps of a method used to make an improved rotor.

Looking now at FIG. 3, a method or process 300 is outlined for the production of an improved rotor such as, for example, the improved rotor 200 of FIGS. 2A and 2B.

The method 300 includes first compacting a powder metal material in a tool and die set to form a powder metal compact according to step 302. It should be appreciated that conventionally such tool and die sets for mass production of powder metal parts uniaxially compact the powder metal. During such uniaxial compaction, an upper tool and lower tool would respectively form and define the opposing axial faces of the rotor, the die would form the outer periphery 210, and a core rod would form the central through hole 208. As such, the formed powder metal compact will have a near net shape approximating the final part shape, although the dimensions of the compact before sintering may be slightly oversized relative to the final sintered part.

One skilled in the art will appreciate that, as used herein, the term powder metal is used to refer to both a metallic component as well as potential lubricants, binders, and/or waxes that may be blended with the metallic component to hold the loose particles together in compact form and to assist in ejection of the compact from the tool and die set. These lubricants, binders, and/or waxes will, in the vast majority of cases, be consumed or burned off during subsequent sintering.

It is noted that the recessed portions relative to the axial planar surfaces may be easily formed in powder metallurgy because the tooling may be shaped to match these recesses and the recessed dimensions may be carefully controlled during compaction.

Next, the powder metal compact is sintered to form a sintered powder metal part according to step 304. During sintering, the powder metal compact is heated to temperatures just below the melting temperatures of the metallic components of powder metal. In some instances, a small fraction of the powder metal may produce a liquid phase for liquid phase sintering; however, in many instances, solid state diffusion will be the primary and sole mechanism by which the powder metal particles sinter together.

After sintering, the powder metal part is then ground on opposing surfaces simultaneously as described above, according to step 306, using for example a Lapmaster® Wolters AC 1200 double-sided batch processing machine. Because the planar axial surfaces on both sides of the part are equilibrated, equalized, or balanced by the inclusion of recessed surfaces on the axial planar faces, this means the finish step of the part can be executed more quickly, efficiently, and accurately than in conventional parts with unbalanced axial sides. As noted above, the opposing grinding wheels may operate at different speeds from one another or at the same speed and may have similar or different rotational directions. Still yet, the rate of pressure applied by the wheels may be varied to alter the removal rate. While variations to all of these grinding parameters may be varied, it should be appreciated that the grinding can occur more accurately and quickly with the rotor 200 having equalized, equilibrated, or balanced planar surface areas.

It will be appreciated that the method 300 can be used to make parts having the form of improved rotor 200 or having the features thereof and that it is the presence of the added recessed surfaces in conjunction with the post-forming grinding step that may provide some benefits to conventional fabrication technique. Thus, while a powder metal rotor for a VVT engine is shown and described herein and the method is particularly applicable and beneficial to making this type of part, it is also contemplated that this modified structure (i.e., the addition of recesses on grinding surfaces) and this improved method may be applied to non-rotor parts or non-powder metal parts (e.g., parts made by casting).

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A method of manufacturing a rotor for a variable valve timing engine, the method comprising the steps of:

compacting a powder metal material in a tool and die set to form a powder metal compact;

sintering the powder metal compact to form a sintered powder metal part, the sintered powder metal part compact having a pair of axial sides each having a respective planar surface to provide a pair of planar surfaces on the sintered powder metal part that are parallel with one another and facing oppositely away from one another, wherein at least one of the pair of axial sides have at least one recessed surface axially offset from the respective planar surface to equalize a surface area of the respective planar surface with a surface area of the other planar surface; and grinding the pair of planar surfaces simultaneously to produce a pair of finished planar surfaces on the sintered powder metal part to produce the rotor;

wherein the surface areas of each one of the pair of planar surfaces are within 15% of each other.

2. The method of claim 1 wherein the surface areas of each one of the pair of planar surfaces are within 10% of each other.

3. The method of claim 1 wherein the surface areas of each one of the pair of planar surfaces are within 5% of each other.

4. The method of claim 1 wherein the rotor includes a central body having a plurality of vanes extending radially outward from the central body.

5. The method of claim 4 wherein, on at least one of the pair of planar surfaces, each of the plurality of vanes has a recessed surface formed therein.

6. The method of claim 4 wherein, on both of the pair of planar surfaces, each of the plurality of vanes has a recessed surface formed therein.

7. The method of claim 4 wherein the sintered powder metal body has an axially-extending through hole and, on one axial side of the sintered powder metal body, the central body has a counter-bored surface extending to the axially-extending through hole and, on the other axial side of the central body, the central body has a recessed surface.

8. The method of claim 7 wherein the recessed surface on the central body is inwardly spaced from an outer peripheral edge and an inner peripheral edge of the respective planar surface on which it is located wherein the inner peripheral edge is shared with the axially-extending through hole.

9. The method of claim 1 wherein both of the pair of planar surfaces each have at least one recessed surface axially offset respectively therefrom.

10. The method of claim 1 wherein the recessed surface is inwardly spaced from a peripheral edge of a respective one of the pair of planar surfaces.

11. The method of claim 10 wherein the recessed surface is spaced at least 2 mm from the peripheral edge.

12. The method of claim 1 wherein the step of grinding the pair of planar surfaces simultaneously utilizes a parallel pair of grinding discs rotating in opposite directions relative to one another.

13. The method of claim 1 wherein the step of grinding the pair of planar surfaces simultaneously utilizes a parallel pair of grinding discs rotating in the same direction relative to one another.

14. The method of claim 1 wherein the at least one recessed surface is between 0.1 mm and 0.2 mm deep relative to the respective planar surface after grinding.

15. A rotor for a variable valve timing engine, the rotor comprising:

a central body;

a plurality of vanes extending radially outward from the central body;

wherein the central body and the plurality of vanes are a unitary component comprising a sintered powder metal;

wherein the rotor has a pair of axial sides each having a respective planar surface to provide a pair of planar surfaces on the rotor that are parallel with one another and facing oppositely away from one another; and wherein at least one of the pair of axial sides have at least one recessed surface axially offset from the respective planar surface to equalize a surface area of the respective planar surface with a surface area of the other planar surface; and wherein the surface areas of each one of the pair of planar surfaces are within 15% of each other.

16. The rotor of claim 15 wherein the sintered powder metal body has an axially-extending through hole and, on one axial side of the sintered powder metal body, the central body has a counter-bored surface extending to the axially-extending through hole and, on the other axial side of the sintered powder metal body, the central body has a recessed surface and wherein, on both of the pair of planar surfaces, each of the plurality of vanes has a recessed surface formed therein.

17. The rotor of claim 15 wherein both of the pair of planar surfaces each have at least one recessed surface axially offset respectively therefrom.

18. The rotor of claim 15 wherein the at least one recessed surface is inwardly spaced from a peripheral edge of a respective one of the pair of planar surfaces, wherein the at least one recessed surface is spaced at least 2 mm from the peripheral edge, and wherein the at least one recessed surface is between 0.1 mm and 0.2 mm deep relative to the respective planar surface.

* * * * *